US006417473B1

(12) United States Patent
Mayo et al.

(10) Patent No.: US 6,417,473 B1
(45) Date of Patent: Jul. 9, 2002

(54) METHOD AND APPARATUS FOR MOUNTING VAPOR SHIELD IN VACUUM INTERRUPTER AND VACUUM INTERRUPTER INCORPORATING SAME

(75) Inventors: Stephen David Mayo, Horseheads; Paul Graham Slade, Ithaca; Benjamin Alex Rosenkrans, Elmira; Dale Lowell Burmingham, Newfield; Bradley Eugene Dunham, Lisle, all of NY (US)

(73) Assignee: Eaton Corporation, Cleveland, OH (US)

( * ) Notice: Subject to any disclaimer, the term of this patent is extended or adjusted under 35 U.S.C. 154(b) by 0 days.

(21) Appl. No.: 09/616,484

(22) Filed: Jul. 14, 2000

(51) Int. Cl.[7] ..... H01H 33/66
(52) U.S. Cl. ..... 218/136; 218/137; 218/118
(58) Field of Search ..... 218/48–76, 118–139, 218/155

(56) References Cited

U.S. PATENT DOCUMENTS

| | | | | |
|---|---|---|---|---|
| 3,048,682 A | | 8/1962 | Veras | |
| 3,646,292 A | * | 2/1972 | Barkan et al. | 218/52 |
| 3,896,282 A | * | 7/1975 | Chabala | 218/43 |
| 4,158,911 A | | 6/1979 | Polinko, Jr. et al. | |
| 4,214,138 A | | 7/1980 | Lucek et al. | |
| RE31,797 E | | 1/1985 | Sakuma et al. | |
| 4,733,456 A | | 3/1988 | Sofianek et al. | |
| 5,929,411 A | | 7/1999 | Schulman | |

* cited by examiner

*Primary Examiner*—Lincoln Donovan
(74) *Attorney, Agent, or Firm*—Martin J. Moran

(57) ABSTRACT

The tubular vapor shield of a vacuum interrupter is secured to the ceramic by a shield mount which includes a split ring seated in a circumferential groove formed in the inner surface of the ceramic. The tubular vapor shield is secured to the split ring by a connection which includes a circumferential flange brazed to the shield and a braze ring which is wedged in an annular gap between the flange and the vapor shield and which melts when heated in a vacuum oven to braze the split ring to the vapor shield and the flange. In another embodiment, the flange has a radial outward rim which seats on the split ring. In an additional embodiment, the connection between the split ring and the vapor shield includes a circumferential shield groove in the outer surface of the vapor shield in which the split ring is also seated and optionally secured by a braze. In yet another embodiment, an additional split ring seated in a circumferential groove in the outer surface of the vapor shield is brazed to the split ring seated in the groove in the ceramic.

18 Claims, 4 Drawing Sheets

METHOD AND APPARATUS FOR MOUNTING VAPOR SHIELD IN VACUUM INTERRUPTER AND VACUUM INTERRUPTER INCORPORATING SAME

BACKGROUND OF THE INVENTION

1. Field of the Invention

This invention relates to vacuum interrupters which provide protection in electric power circuits. More particularly, it relates to an arrangement and method for mounting a vapor shield inside the ceramic insulator forming the vacuum envelope of the interrupter.

2. Background Information

Vacuum interrupters typically have a tubular ceramic capped by end plates to form a vacuum envelope. A fixed contact mounted in the vacuum envelope on a first electrode extending through one end cap, and a moveable contact mounted on a moveable electrode axially slideable through the other end plate form a pair of separable contacts which are opened and closed by movement of the moveable electrode by a mechanism located outside of the vacuum envelope. When the separable contacts are opened with current flowing through the vacuum interrupter, a metal-vapor arc is struck between the contact surfaces. This arc continues until the current is interrupted, typically as the ac current goes through a zero crossing. In order to prevent the metal vapor from condensing on the ceramic insulator, a generally cylindrical metal vapor shield is typically provided between the contacts and the ceramic inside the vacuum envelope. One type of vapor shield, the fixed shield, is electrically tied to one electrode, e.g., the fixed electrode, and therefore, can be physically supported by that electrode. The second common type of vapor shield is the floating shield which is electrically isolated from both electrodes. While it is widely known that the floating shield performs better at high voltages than the fixed shield designs, it is more difficult to mount.

One common arrangement for mounting a floating vapor shield requires that the ceramic be formed in two cylindrical parts with a metal mounting ring sandwiched between. The vapor shield is then secured to this mounting ring, typically by discrete flanges brazed to the shield and the mounting ring. While functionally adequate, this arrangement can have several disadvantages. First, attaching the shield in this manner requires two braze joints which have vacuum on one side and air on the other, thereby providing two potential leak paths. Second, the two cylindrical ceramics must be metalized at both ends, which leads to an increased cost. Lastly, the support mechanism exposes a conductor to the air leading to the need for external insulation for high voltage applications.

For these reasons, it is highly desirable to attach a floating shield inside a single ceramic. One approach has been to crimp the shield around a feature such as a ridge molded as part of the ceramic. This is time consuming and adds a fair amount of cost to the ceramic. Various other approaches to attaching the floating shield to a single piece ceramic have required specialized components which add complexity and cost.

There is a need, therefore, for an improved arrangement and method for securing a floating vapor shield in a vacuum interrupter.

There is a general need for such an improved mount and method of mounting which do not require complex specialized parts or techniques.

More particularly, there is also a need for such an improved mount and method which can be used with a single piece ceramic.

SUMMARY OF THE INVENTION

This invention satisfies these needs and others by providing a vacuum interrupter with a single piece ceramic tube having a circumferential groove in an inner surface. A pair of end members form with this single piece ceramic tube a vacuum enclosure. A fixed contact is mounted on a fixed electrode extending through one end member. A moveable contact is mounted on a moveable electrode extending through the other end member and axially reciprocal into and out of contact with the fixed contact. A tubular shield is supported inside the ceramic tube and surrounding the fixed and moveable contacts by a shield mount. This shield mount includes a split ring seated in the circumferential groove in the ceramic tube and projecting radially inward from the inner surface of the ceramic tube into the vacuum envelope where a connection connects the shield to the split ring.

The connection between the split ring and the vacuum shield can take several forms. In a preferred form of the invention, this connection includes a flange fixed to the outer surface of the tubular shield and a braze ring fixing the flange to the split ring. Also preferably, the flange forms a gap with the outer surface of the tubular shield and the braze is formed from a braze ring positioned in the gap where it fixes the split ring to the flange in the outer surface of the tubular shield. In one embodiment of the invention, the flange has a radially extending terminal section which seats on the split ring. Also preferably, the flange extends substantially fully around the tubular shield.

In another aspect of the invention, the connection connecting the vapor shield to the split ring includes a circumferential shield groove in an outer surface of the shield, and an additional split ring installed in the groove in the shield and projecting radially outward. A braze connection fixes the additional split ring in the groove in the shield to the split ring seated in the ceramic tube.

In accordance with another aspect of the invention, the connection connecting the split ring seated in the ceramic tube to the shield comprises an additional circumferential groove in the outer surface of the vapor shield in which the split ring seats directly. This connection can be further augmented by including a braze ring to fix the split ring to the shield.

The invention also is directed to a method of securing a floating vapor shield in a vacuum interrupter which includes the steps of forming a circumferential groove in the ceramic tube, installing a split ring in the groove, and fastening the vapor shield to the split ring. The preferred form of fastening is implemented by providing a flange on the outer surface of the shield and fixing the flange to the split ring, preferably by brazing. In a preferred method, the flange is formed with a gap between the flange and the shield and a braze ring is seated in this gap. The shield is then positioned in the ceramic tube with the flange engaging the split ring. Heat is applied, preferably in a vacuum, to melt the braze ring.

In accordance with another aspect of the invention, the shield is fastened to the split ring by forming a shield groove in the outer surface of the tubular shield, installing an additional split ring in this shield groove, and then brazing the additional split ring to the split ring installed in the ceramic tube. Preferably, the brazing is accomplished by placing the braze ring on top of the additional split ring, inserting the shield into the ceramic tube with the additional split ring seated on the additional split ring and applying heat to melt the braze ring.

In still another aspect of the invention, the tubular shield is fastened to the split ring by providing the tubular shield with a shield groove in an outer surface and installing the split ring in this shield groove as well as in the groove in the ceramic tube. Preferably, the split ring is brazed to the tube shield.

The split ring is installed in the ceramic tube by compressing it to reduce its outside diameter to an outer dimension which is less than the inner diameter of the ceramic tube, aligning the compressed split ring with the groove in the ceramic tube and releasing the split ring to radially expand into the groove.

BRIEF DESCRIPTION OF THE DRAWINGS

A full understanding of the invention can be gained from the following description of the preferred embodiments when read in conjunction with the accompanying drawings in which.

DESCRIPTION OF THE PREFERRED EMBODIMENTS

Figure 1:
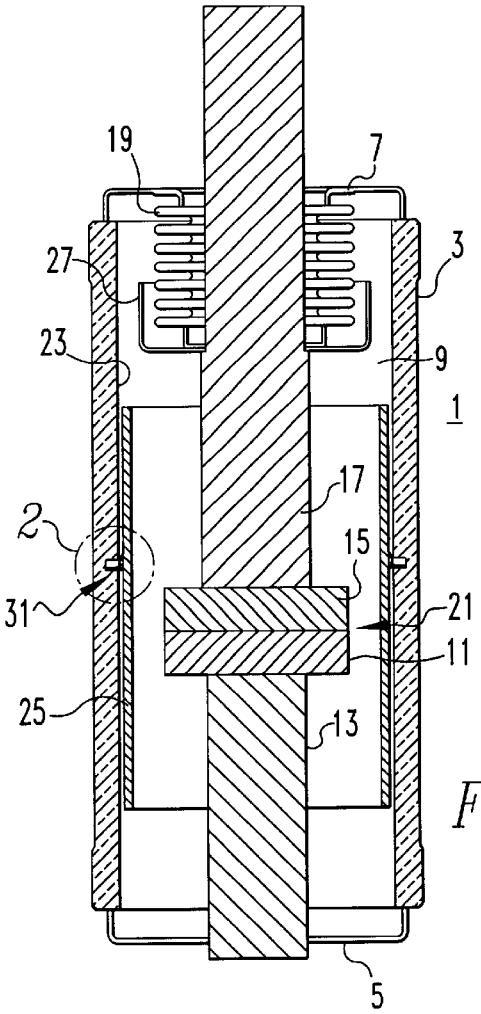
FIG. 1 is a longitudinal sectional view through a vacuum interrupter incorporating the invention.

FIG. 1 illustrates a vacuum interrupter 1. The vacuum interrupter 1 includes a ceramic tube 3 which with end plates 5 and 7 forms a vacuum envelope 9. A fixed contact 11 is mounted on a fixed electrode 13 which extends through the end plate 5. A moveable contact 15 is carried by a moveable electrode 17 and extends through the end plate 7. A bellows 19 forms a seal between the end plate 7 and the moveable electrode 17 while allowing axial movement of the moveable electrode 17 to bring the moveable contact 15 into and out of contact with the fixed contact 11. The fixed contact 11 and moveable contact 15 form separable contacts 21 which when closed, complete an electrical circuit between the fixed electrode 13 and moveable electrode 17, and when opened by axial movement of the moveable electrode 17 interrupt current flowing through the vacuum interrupter. The moveable electrode 17 is moved axially to open and close the separable contacts by an operating mechanism (not shown) connected to the moveable electrode outside of the vacuum envelope 9.

As has been discussed, when the separable contacts 21 are opened with current flowing through the vacuum interrupter, an arc is struck between the fixed contact 11 and the moveable contact 15. These contacts are configured to aid in extinguishing the arc which is necessary to interrupt the current flowing through the vacuum interrupter, as is well known. As was also mentioned above, the arc vaporizes metal from the contacts 11 and 15 which could be deposited on the inner surface 23 of the ceramic 3 which serves as an electrical insulator, as well as defining the vacuum envelope 9. In order to prevent such deposits, it is well known to provide a tubular vapor shield 25 between the separable contacts 21 and the ceramic 3. This tubular vapor shield 25 is generally cylindrical, and as shown in FIG. 1, is necked down to a degree at each end to extend its protection of the inner surface 23 of the ceramic 3. It is common to also provide an end shield 27 mounted on the moveable electrode 17 to protect the bellows 19 from metal-vapor deposits.

The vapor shield 25 is a floating shield. That is, it is not electrically connected to either electrode so that its potential floats. To provide this electrical isolation, the vapor shield 25 is supported by the ceramic 3 which, as mentioned, is an electrical insulator.

Figure 2:
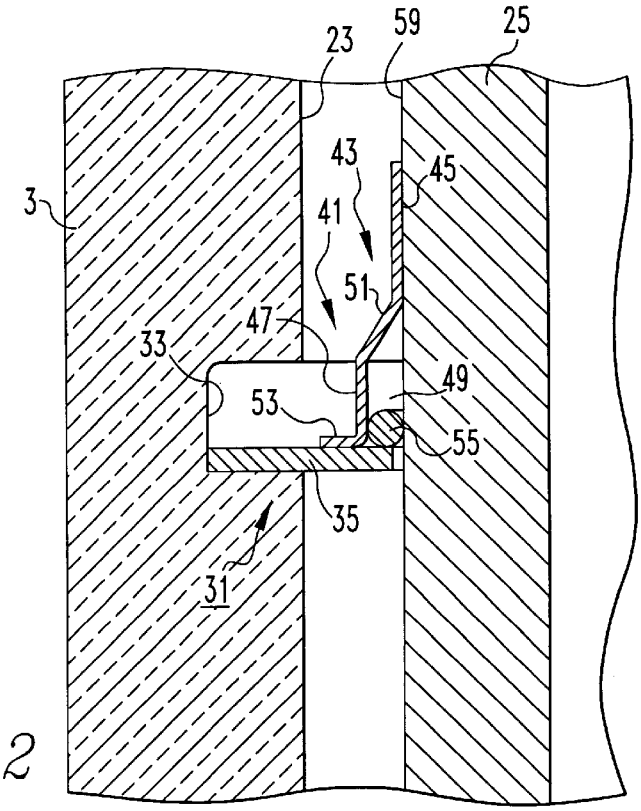
FIG. 2 is a fragmentary view in enlarged scale of a section of FIG. 1.
Figure 3:
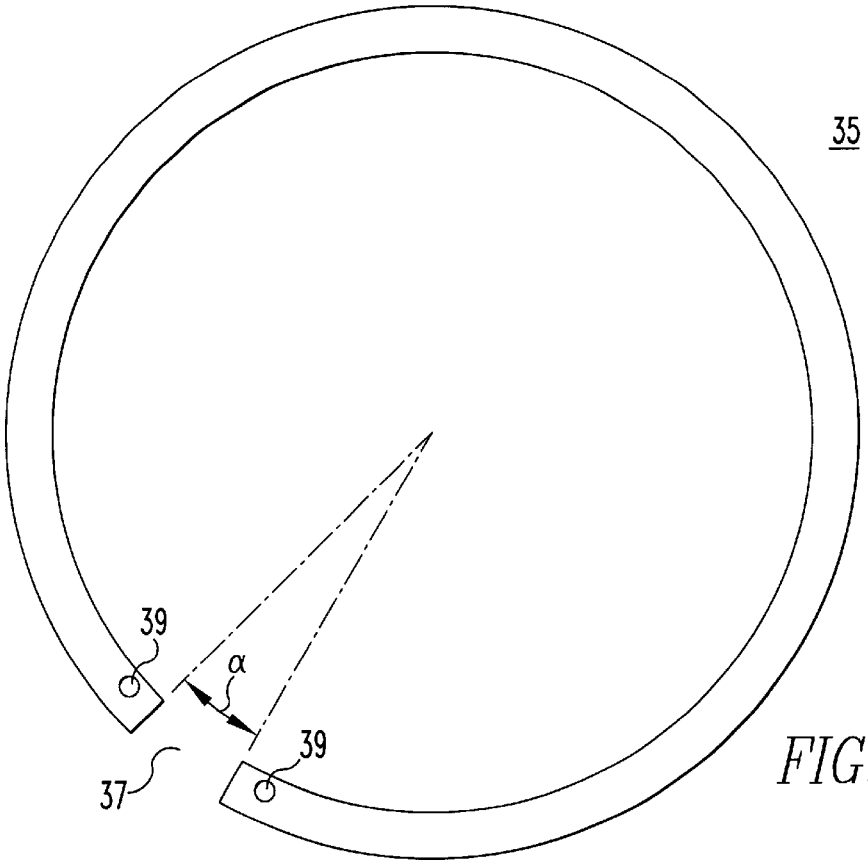
FIG. 3 is a plane view of one type of split ring which forms part of the arrangement shown in FIG. 2.

In accordance with the invention and as more clearly seen in FIG. 2, the tubular shield 25 is secured to the ceramic 3 by a shield mount 31 which includes a radially extending, circumferential groove 33 which is machined in the inner surface 23 of the ceramic 3 and a ring such as the split ring 35 which is installed in the groove 33. As shown in FIG. 3, the exemplary split ring 35 has a gap 37 which permits the split ring to be radially compressed for insertion within the ceramic 3. Holes 39 accommodate pins on a conventional tool (not shown) used to manipulate the split ring. One of the advantages of the invention is that the split ring 35 may be a conventional "snap ring" or "retainer ring" which are widely used and therefore inexpensive. The split ring 35 is seated in the groove 33 in the ceramic 3 and is sized so that it projects radially inward from the inner surface 23 of the ceramic 3. The gap 37 in the split ring 35 is sized to permit the ring to be compressed sufficiently for insertion inside the ceramic tube 3. In the exemplary split ring, the gap 37 subtends an angle $\alpha$ of about 15°.

The tubular vapor shield 25 is then secured to the split ring 35 by a connection 41. In the embodiment of the invention illustrated in FIGS. 1 and 2, this connection 41 includes a flange 43 with a cylindrical section 45 at one end which is secured to the outer surface of the tubular vapor shield 25 such as by brazing. Preferably, this flange 43 is continuous around the tubular vapor shield 25. The other end 47 of the flange 43 is also cylindrical but of larger diameter to form a gap 49 with the tubular shield 25. A tapered section 51 joins the cylindrical sections 45 and 47. A radial lip 53 on the cylindrical section 47 seats on the split ring 35. The connection 41 further includes a braze formed by a braze ring 55 which is seated in the gap 49.

The method for securing the arc shield 25 to the ceramic tube using the shield mount 31 shown in FIGS. 1 and 3 includes: forming, such as by machining, the groove 33 in the inner surface 23 of the ceramic 3, installing a ring, such as the split ring 35 in this groove 33 by radially compressing the split ring 35 using a tool (not shown) which engages the holes 39, aligning the compressed split ring 35 with the groove 33 and releasing the split ring, allowing it to expand into the groove but still projecting radially into the vacuum envelope 9. Next, the flange 43 is secured to the arc shield 25 such as by brazing and the braze ring 55 is wedged into the gap 49 between the flange 43 and the arc shield 25. The arc shield is then axially inserted into the ceramic 3 to seat the lip or rim 51 of the flange 43 against the split ring 35. The ceramic and arc shield are then placed in a vacuum oven which melts the braze ring 55 allowing the braze material to flow between the split ring 35 and the rim 51 of the flange 43 and between the split ring and the arc shield 25. Finally, the braze is allowed to cool to solidify the connection.

Figure 4:
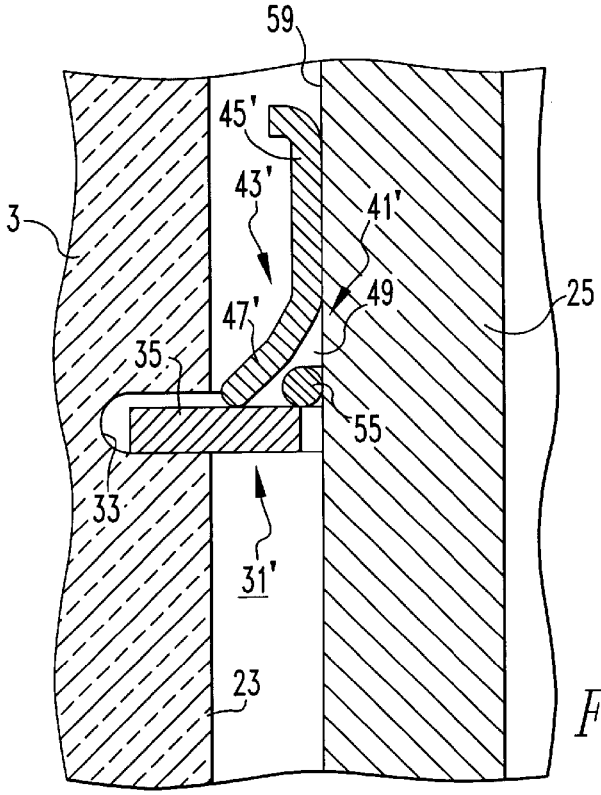
FIG. 4 is a view similar to FIG. 2 of another embodiment of the invention.

FIG. 4 illustrates another embodiment of the invention in which the shield mount 31' uses a connection 41' in which the flange 43' has a cylindrical end section 45' brazed to the arc shield 25 and the other end section 47' is flared outward to form a gap 49. Again, a braze ring 55 is wedged into this gap 49 between the flange 43' and the arc shield 25. As in the case of the first embodiment, the braze ring 55 melts when placed in a vacuum oven and forms a braze connection between the split ring 35, the arc shield 25 and the flange 43'.

Figure 5:
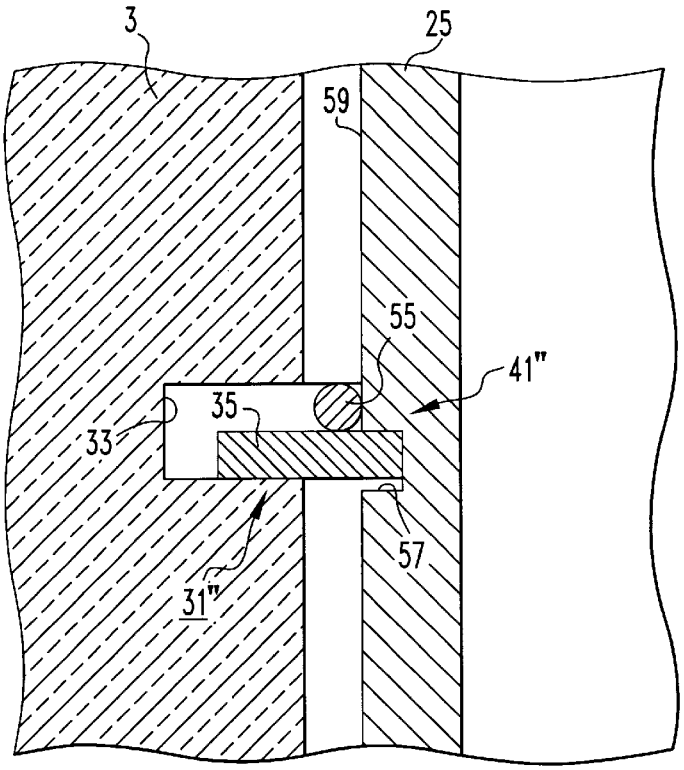
FIG. 5 is a view similar to FIG. 2 of an additional embodiment of the invention.
Figure 6:
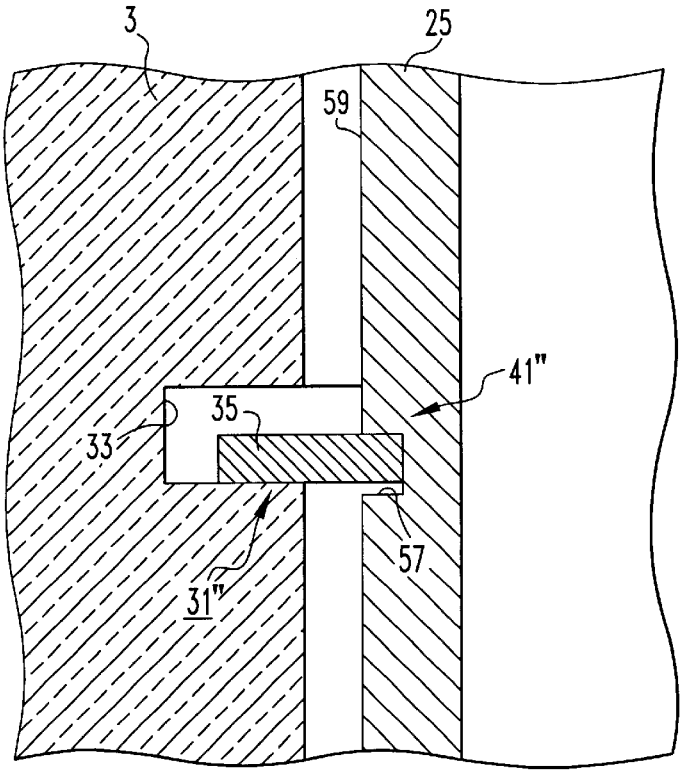
FIG. 6 illustrates a variation of the embodiment of the invention illustrated in FIG. 5.

An additional embodiment of the invention is illustrated in FIG. 5 where he shield mount 31" has a connection 41" which includes a circumferential shield groove 57 formed, such as by machining, in the outer surface 59 of the shield 25 in which the inner edge of the split ring 35 is seated. This connection 41" also includes a braze ring 55 which is dropped down on top of the split ring 35 and which melts to braze the split ring to the arc shield 25 when heated in the vacuum oven. In this embodiment, the split ring 35 is slightly compressed radially and snapped into the groove 33 in the ceramic 3. The vapor shield 25 is then pressed into the split ring 35 causing it to expand within the groove 33 in the ceramic 3 until the shield groove 57 becomes aligned with the split ring 35 which then springs inward to engage the shield groove. In a variation of this embodiment of the invention, the braze insert can be eliminated as shown in FIG. 6.

Figure 7:
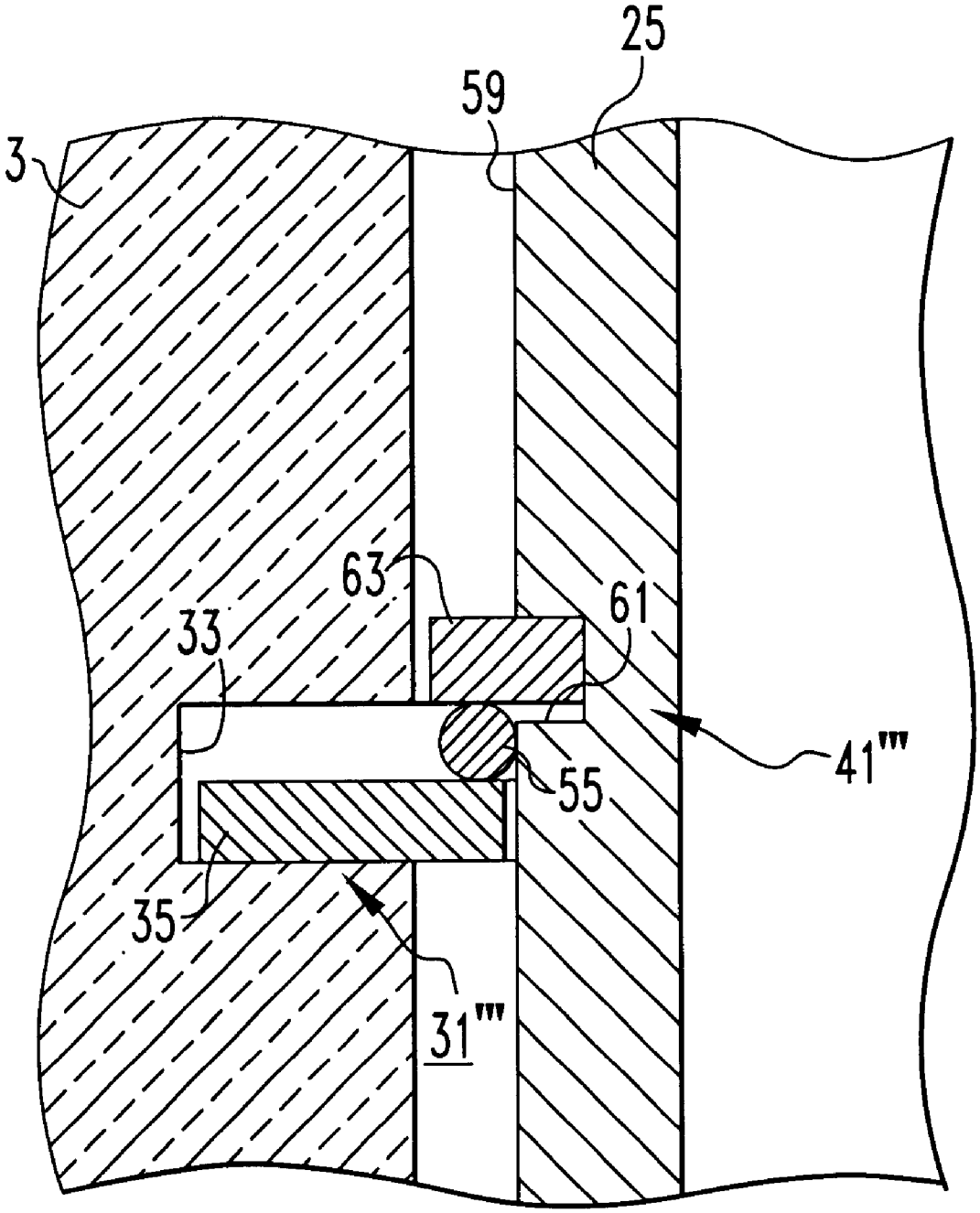
FIG. 7 is a view similar to FIG. 2 of yet another embodiment of the invention.

Yet another embodiment of the invention is illustrated in FIG. 7. Here, the shield mount 31'" has a connection 41'" which includes an additional circumferential groove 61 formed, such as by machining, in the outer surface 59 of the arc shield and in which is seated an additional split ring 63. In this arrangement, the braze ring 55 is dropped down on top of the split ring 35, and the arc shield is then inserted in the ceramic until the additional split ring 63 seats on top of the braze ring 53, which melts in the vacuum oven to braze the split ring 35 to the arc shield 25 and to the additional split ring 63.

Typically, the ceramic is $Al_2O_3$ material, the arc shield 25 is copper or steel, the split ring 35 and the additional split ring 63 are 316 stainless steel and the flanges 43 and 43' are 304 stainless steel.

The invention provides a mount for the tubular arc shield in a vacuum interrupter and a method of securing it within the ceramic which uses commonly available split rings and other simple parts which are easily assembled to provide a secure mount for the arc shield. In addition, a single piece ceramic can be used so that it is not necessary to form the ceramic in two pieces and metalize both ends of each piece. Therefore, it also eliminates the electrical isolation problem of the prior art technique of having a metal ring exposed at the outer surface of the ceramic, and consequently also eliminates the need for electrically isolating this ring. The result is a less expensive and easier to implement arrangement.

While specific embodiments of the invention have been described in detail, it will be appreciated by those skilled in the art that various modifications and alternatives to those details could be developed in light of the overall teachings of the disclosure. Accordingly, the particular arrangements disclosed are meant to be illustrative only and not limiting as to the scope of the invention which is to be given the full breadth of the claims appended and any and all equivalents thereof.

What is claimed is:

1. A vacuum interrupter comprising:

a single piece ceramic tube having a circumferential groove in an inner surface thereof;

end members secured to each end of the ceramic tube to form therewith a vacuum envelope;

a fixed contact mounted on a fixed electrode extending through one end member;

a moveable contact mounted on a moveable electrode extending through the other end member and axially reciprocating into and out of contact with the fixed contact;

a tubular shield inside the ceramic tube and surrounding the fixed contact and moveable contact; and a shield mount comprising a split ring installed in the circumferential groove in the ceramic tube and projecting radially inward into the vacuum envelope, and a connection connecting the tubular shield to the split ring.

2. The vacuum interrupter of claim 1 wherein the connection comprises a flange fixed to an outer surface of the tubular shield and a braze connection fixing the flange to the split ring.

3. The vacuum interrupter of claim 2 wherein the flange forms a radial gap with the outer surface of the tubular arc shield and the braze connection comprises a braze ring seated in the gap and which melts to fix the flange to the split ring.

4. The vacuum interrupter of claim 3 wherein the flange has a radially extending terminal lip which abuts the split ring.

5. The vacuum interrupter of claim 3 wherein the flange extends substantially fully around the tubular shield.

6. The vacuum interrupter of claim 1 wherein the connection comprises a circumferential shield groove in an outer surface of the tubular shield, an additional split ring installed in the shield groove and projecting radially outward, and a braze connection fixing the additional split ring to the split ring installed in the ceramic tube.

7. The vacuum interrupter of claim 1 wherein the connection comprises a circumferential shield groove in an outer surface of the tubular shield in which the split ring is seated.

8. The vacuum interrupter of claim 7 wherein the connection further includes a braze connection fixing the split ring to the tubular shield.

9. A method of securing a tubular shield within a ceramic tube of a vacuum interrupter comprising the steps of:

forming a circumferential groove on an inner surface of the ceramic tube;

installing a split ring in the circumferential groove with the split ring projecting radially inward from the inner surface of the ceramic tube; and fastening the tubular shield to the split ring.

10. The method of claim 9 wherein the fastening step comprises providing a flange on an outer surface of the tubular shield, and fixing the flange to the split ring.

11. The method of claim 10 wherein the step of fixing comprises brazing.

12. The method of claim 11 including forming the flange with a gap between the flange and the outer surface of the tubular shield, seating a braze ring in the gap, positioning the tubular shield within the ceramic tube with the flange engaging the split ring, applying heat to melt the braze ring, and cooling the melted braze.

13. The method of claim 12 wherein the heat is applied in a vacuum.

14. The method of claim 9 wherein the tubular shield is fastened to the split ring by providing a circumferential shield groove in an outer surface of the tubular shield, installing an additional split ring in the shield groove, and brazing the additional split ring to the split ring installed in the ceramic tube.

15. The method of claim 14 wherein the brazing comprises placing a braze ring on the top of the split ring installed in the ceramic tube, inserting the tubular shield into the ceramic tube with the additional split ring seated on the braze ring, and applying heat to melt the braze ring.

16. The method of claim 9 wherein the fastening comprises providing the tubular shield with a shield groove in an outer surface, installing the split ring in the shield groove also.

17. The method of claim 16 further including brazing the split ring to the tubular shield.

18. The method of claim 9 wherein installing the split ring comprises compressing the split ring to reduce its outside diameter to less than an inside diameter of the ceramic tube, aligning the compressed split ring with the groove, and releasing the split ring to radially expand into the groove.

* * * * *